US007727096B2

(12) United States Patent
Davis et al.

(10) Patent No.: US 7,727,096 B2
(45) Date of Patent: Jun. 1, 2010

(54) COMPOSITE HOCKEY STICK SYSTEM

(75) Inventors: Stephen J. Davis, Newtown, PA (US); Roberto Gazzara, Mestre (IT); Mauro Pinaffo, Camposampiero (IT); Michele Pozzobon, Fossalunga di Vedelago (IT); Mauro Pezzato, Treviso (IT)

(73) Assignee: Prince Sports, Inc., Bordentown, NJ (US)

( * ) Notice: Subject to any disclaimer, the term of this patent is extended or adjusted under 35 U.S.C. 154(b) by 0 days.

(21) Appl. No.: 11/752,574

(22) Filed: May 23, 2007

(65) Prior Publication Data

US 2007/0275800 A1 Nov. 29, 2007

Related U.S. Application Data

(63) Continuation of application No. 11/183,585, filed on Jul. 18, 2005, now abandoned.

(51) Int. Cl.
*A63B 59/14* (2006.01)

(52) U.S. Cl. ..... 473/561

(58) Field of Classification Search ..... 473/560–568, 473/513, 316–321, 519, 520, 549–551
See application file for complete search history.

(56) References Cited

U.S. PATENT DOCUMENTS

| | | | | |
|---|---|---|---|---|
| 59,313 | A | | 10/1866 | Hill |
| 729,639 | A | | 6/1903 | McCoy |
| 1,025,478 | A | | 5/1912 | Murphy |
| 1,530,427 | A | | 3/1925 | Simon |
| 2,033,722 | A | | 3/1936 | MacFarland |
| 2,321,773 | A | | 6/1943 | Rumelin |
| 3,377,066 | A | | 4/1968 | Trowbridge |
| 3,392,976 | A | | 7/1968 | Hayes |
| 4,086,115 | A | | 4/1978 | Sweet et al. |
| 4,124,208 | A | * | 11/1978 | Burns ..... 473/562 |
| 4,264,389 | A | | 4/1981 | Staub |
| 4,358,113 | A | * | 11/1982 | McKinnon et al. ..... 473/561 |
| 4,600,193 | A | | 7/1986 | Merritt |
| 4,795,153 | A | * | 1/1989 | Thomas ..... 473/316 |
| 4,931,247 | A | | 6/1990 | Yeh |
| 5,082,279 | A | | 1/1992 | Hull |
| 5,097,870 | A | | 3/1992 | Williams |

(Continued)

FOREIGN PATENT DOCUMENTS

| | | |
|---|---|---|
| CA | 2154370 | 3/1997 |

(Continued)

OTHER PUBLICATIONS

U.S. Appl. No. 11/509,999, filed Aug. 26, 2006, Stephen J. Davis.

(Continued)

*Primary Examiner*—Mark S Graham
(74) *Attorney, Agent, or Firm*—Abelman, Frayne & Schwab

(57) ABSTRACT

A handle end is adapted to be held by a player and a striking end is adapted to contact and propel an object. The stick includes a shaft coupling the handle end and the striking end. The shaft is fabricated of a relatively rigid material with limited flexibility. The shaft has a hole extending there through with a cylindrical wall defining the hole for varying the playing characteristics of the system.

9 Claims, 3 Drawing Sheets

U.S. PATENT DOCUMENTS

| | | | | |
|---|---|---|---|---|
| 5,153,798 | A | | 10/1992 | Ruigrok |
| 5,179,255 | A | | 1/1993 | Yeh |
| 5,249,846 | A | | 10/1993 | Martin et al. |
| 5,285,008 | A | * | 2/1994 | Sas-Jaworsky et al. ..... 174/47 |
| 5,301,940 | A | | 4/1994 | Seki |
| 5,303,916 | A | | 4/1994 | Rodgers |
| 5,419,553 | A | | 5/1995 | Rodgors |
| 5,636,836 | A | | 6/1997 | Carroll et al. |
| 5,746,955 | A | | 5/1998 | Calapp et al. |
| 5,766,104 | A | | 6/1998 | Albarelli |
| 5,865,696 | A | | 2/1999 | Calapp et al. |
| 5,879,250 | A | * | 3/1999 | Tahtinen et al. ..... 473/561 |
| 5,975,645 | A | | 11/1999 | Sargent |
| 6,042,493 | A | | 3/2000 | Chauvin |
| 6,086,161 | A | | 7/2000 | Luttgeharm et al. |
| 6,113,508 | A | | 9/2000 | Locarno |
| 6,129,962 | A | * | 10/2000 | Quigley et al. ..... 428/36.1 |
| 6,241,633 | B1 | | 6/2001 | Conroy |
| 6,383,101 | B2 | | 5/2002 | Eggiman |
| 6,485,382 | B1 | | 11/2002 | Chen |
| 6,663,517 | B2 | | 12/2003 | Buiatti |
| 6,723,012 | B1 | | 4/2004 | Sutherland |
| 6,761,653 | B1 | | 7/2004 | Higginbotham |
| 6,764,419 | B1 | | 7/2004 | Giannetti |
| 6,776,735 | B1 | | 8/2004 | Belanger |
| 6,800,239 | B2 | | 10/2004 | Davis |
| 6,808,464 | B1 | | 10/2004 | Nguyen |
| 6,866,598 | B2 | | 3/2005 | Giannetti |
| 6,872,156 | B2 | | 3/2005 | Ogawa |
| 7,014,580 | B2 | | 3/2006 | Forsythe |
| 7,207,907 | B2 | | 4/2007 | Guenther |
| 7,309,299 | B2 | | 12/2007 | Pezzato |
| 7,396,303 | B2 | | 7/2008 | Gazzara |
| 2003/0104152 | A1 | | 6/2003 | Sommer |
| 2003/0162613 | A1 | | 8/2003 | Davis |
| 2004/0048683 | A1 | | 3/2004 | Burrows |
| 2004/0198538 | A1 | | 10/2004 | Goldsmith |
| 2004/0198539 | A1 | | 10/2004 | Sutherland |
| 2005/0062337 | A1 | | 3/2005 | Meggiolan et al. |
| 2005/0153798 | A1 | | 7/2005 | Rigoli |
| 2005/0153799 | A1 | * | 7/2005 | Rigoli ..... 473/513 |
| 2005/0164814 | A1 | | 7/2005 | Tucker et al. |
| 2005/0221924 | A1 | | 10/2005 | Sutherland |
| 2006/0122013 | A1 | | 6/2006 | Dodge |
| 2006/0172828 | A1 | | 8/2006 | Pezzato et al. |
| 2006/0247077 | A1 | | 11/2006 | Deetz |
| 2007/0123376 | A1 | | 5/2007 | Gazzara |
| 2007/0135245 | A1 | | 6/2007 | Gazzara |
| 2007/0200422 | A1 | | 8/2007 | Davis |
| 2007/0222178 | A1 | | 9/2007 | Davis |
| 2007/0238560 | A1 | | 10/2007 | Gazzara |
| 2007/0293344 | A1 | | 12/2007 | Davis |

FOREIGN PATENT DOCUMENTS

| | | |
|---|---|---|
| CA | 2231908 | 9/1999 |
| DE | 4415509 | 11/1995 |
| EP | 1859838 | 11/2007 |
| EP | 1859839 | 11/2007 |
| JP | 53038431 | 4/1978 |
| JP | 02255164 | 10/1990 |
| JP | 05015624 | 1/1993 |
| JP | 09117968 | 5/1997 |
| JP | 11276652 | 10/1999 |
| JP | 2000042155 | 2/2000 |
| WO | WO 84/03447 | 9/1984 |
| WO | WO 94/26361 | 11/1994 |
| WO | WO 00/09219 | 2/2000 |
| WO | WO01/26752 | 4/2001 |
| WO | WO 03/076176 | 9/2003 |
| WO | WO 2004/075996 | 9/2004 |

OTHER PUBLICATIONS

U.S. Appl. No. 11/636,294, filed Dec. 8, 2006, Gazzara et al.
U.S. Appl. No. 11/636,314, filed Dec. 8, 2006, Gazzara et al.
U.S. Appl. No. 11/524,990, filed Sep. 20, 2006, Stephen J. Davis.
European Patent Office, Extended European Search Report for EP06114348.3, Nov. 22, 2006.
US 7,223,188, 05/2007, Davis (withdrawn)

* cited by examiner

FIG 3
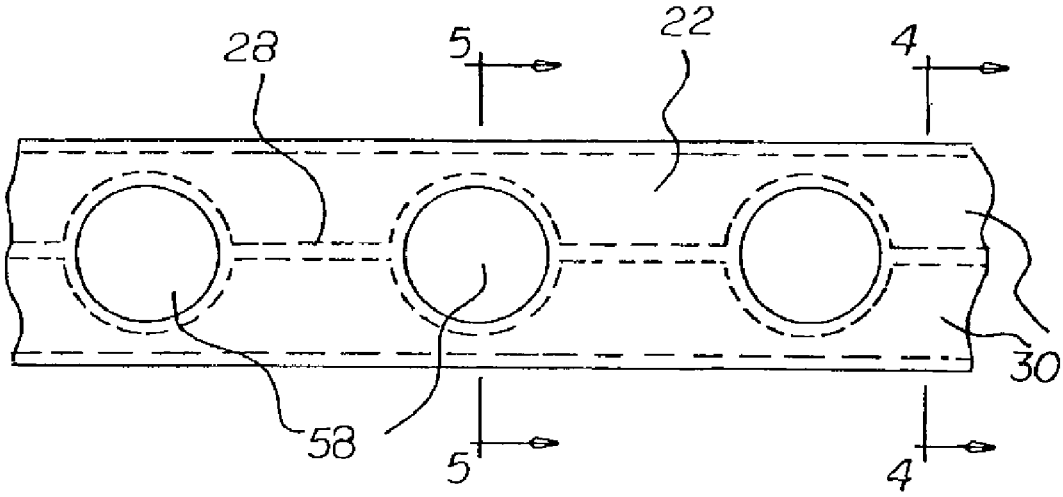
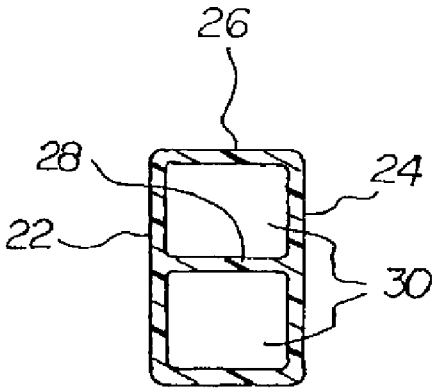
FIG 4
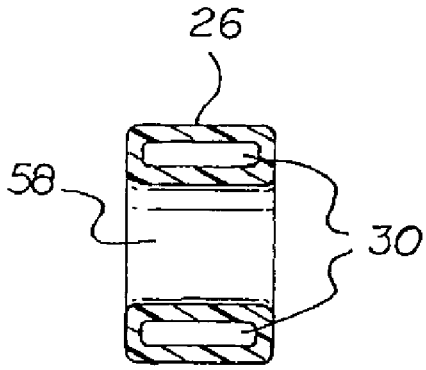
FIG 5

COMPOSITE HOCKEY STICK SYSTEM

CROSS-REFERENCE TO RELATED APPLICATIONS

This application is a continuation of U.S. application Ser. No. 11/183,585, filed on Jul. 18, 2005, which is incorporated herein by reference to the extent it is not inconsistent with the instant disclosure.

BACKGROUND OF THE INVENTION

1. Field of the Invention

The present invention relates to a hockey stick system and more particularly pertains to a hockey stick system fabricated of a plurality of composite layers molded in such a way as to produce a geometric change in the shaft.

2. Description of the Prior Art

This invention relates to an improved hockey stick system. In particular, it is made from fiber reinforced resin material molded in a tubular form using two internal tubes which can be separated to form openings or spaces between the tubes.

Hockey stick systems have traditionally been made from wood. Wood has been a convenient and traditional material to use but is limited in strength and weight. The wood stick is solid and can be made from a multi ply lamination in order to improve strength.

Recent developments have improved hockey sticks by making them out of metal such as aluminum. This sticks are typically made from a one piece extruded aluminum tube to which can be attached a blade and handle. The tubular construction offers a lighter weight and also easy attachment for the blade and handle.

More recent developments have advanced hockey stick performance by using composite materials such as fiber reinforced resins such as carbon fiber in an epoxy resin. These sticks are tubular in form to maximize strength and minimize weight.

The prior art discloses improved hockey sticks made with alternate materials, specifically composite materials such as fiber reinforced thermoset resins. Composite materials are attractive alternatives to wood, because there exists a large selection of fiber types and resin types, the combinations of which can produce a multitude of options suitable for replacement to wood. These composite laminates have the advantage of being stiffer, stronger, and less susceptible to environmental changes than wood.

One of the first patents describing composite materials used for hockey sticks is U.S. Pat. No. 4,086,115 to Sweet which discloses a tubular hockey stick manufactured using fiberglass fibers in a polyester resin made using a pultrusion process.

U.S. Pat. Nos. 5,419,553 and 5,303,916 to Rogers disclose an improved hockey stick made from composite materials, also made using the pultrusion process, with the addition of specific fiber orientation in order to improve the stiffness and strength of the stick.

U.S. Pat. No. 5,636,836 to Carroll and U.S. Pat. No. 5,746,955 to Calapp and U.S. Pat. No. 5,865,696 to Calapp and U.S. Pat. No. 6,241,633 to Conroy all describe tubular hockey stick systems made from fiber reinforced resin materials with specific fiber orientation in order to achieve desired performance characteristics.

The hockey stick system according to the present invention substantially departs from the conventional concepts and designs of the prior art and in doing so provides an apparatus primarily developed for the purpose of improved aerodynamics, strength and appearance.

Therefore, it can be appreciated that there exists a continuing need for an improved hockey stick system. In this regard, the present invention substantially fulfills this need.

SUMMARY OF THE INVENTION

In view of the foregoing commonality inherent in the known types of composite hockey stick systems of known designs and configurations now present in the prior art, the present invention provides an improved hockey stick system. As such, the general purpose of the present invention, which will be described subsequently in greater detail, is to provide a new and improved hockey stick system has all the advantages of the prior art and none of the disadvantages.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved composite hockey stick system which has all of the advantages of the prior art of known designs and configurations and none of the disadvantages.

It is another object of the present invention to provide a new and improved composite hockey stick system which may be easily and efficiently manufactured and marketed.

It is further an object of the present invention to provide a new and improved composite hockey stick system which is of durable and reliable construction.

An even further object of the present invention is to provide a new and improved composite hockey stick system which is susceptible of a low cost of manufacture with regard to both materials and labor, and which accordingly is then susceptible of low prices of sale to the consuming public, thereby making such hockey stick economically available to the buying public.

Even still another object of the present invention is to provide a hockey stick system which has less aerodynamic drag therefore improving the maneuverability of the hockey stick.

Even still another object of the present invention is to provide a hockey stick system which allows more flexibility in the lower portion of the shaft nearer the blade.

Even still another object of the present invention to provide a new and improved composite hockey stick system made with two tubes fused together to form an internal wall for improved strength.

Lastly, it is an object of the present invention to provide a new and improved composite hockey stick system made with two tubes fused together to form an internal wall for improved strength, and with ports or spaces molded between the tubes to act as aerodynamic apertures to provide less aerodynamic drag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged front elevational view of the hockey stick system shown in FIG. 1 illustrating the holes in greater detail.

FIGS. 4 and 5 are cross sectional views taken along lines 4-4 and 5-5 of in FIG. 3.

The same reference numerals refer to the same parts throughout the various Figures.

DESCRIPTION OF THE PREFERRED EMBODIMENT

Figure 1:
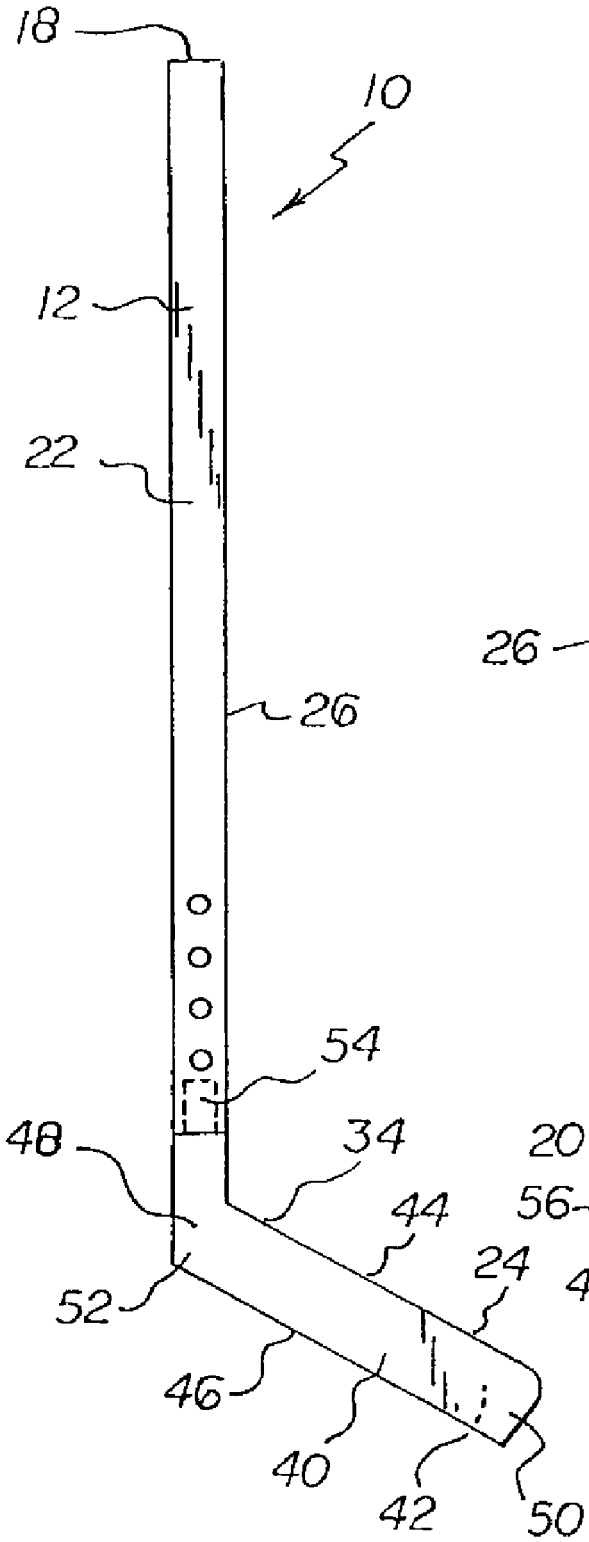
FIG. 1 is a front elevational view of a hockey stick system, shaft and blade, constructed in accordance with the principles of the present invention.
Figure 2:
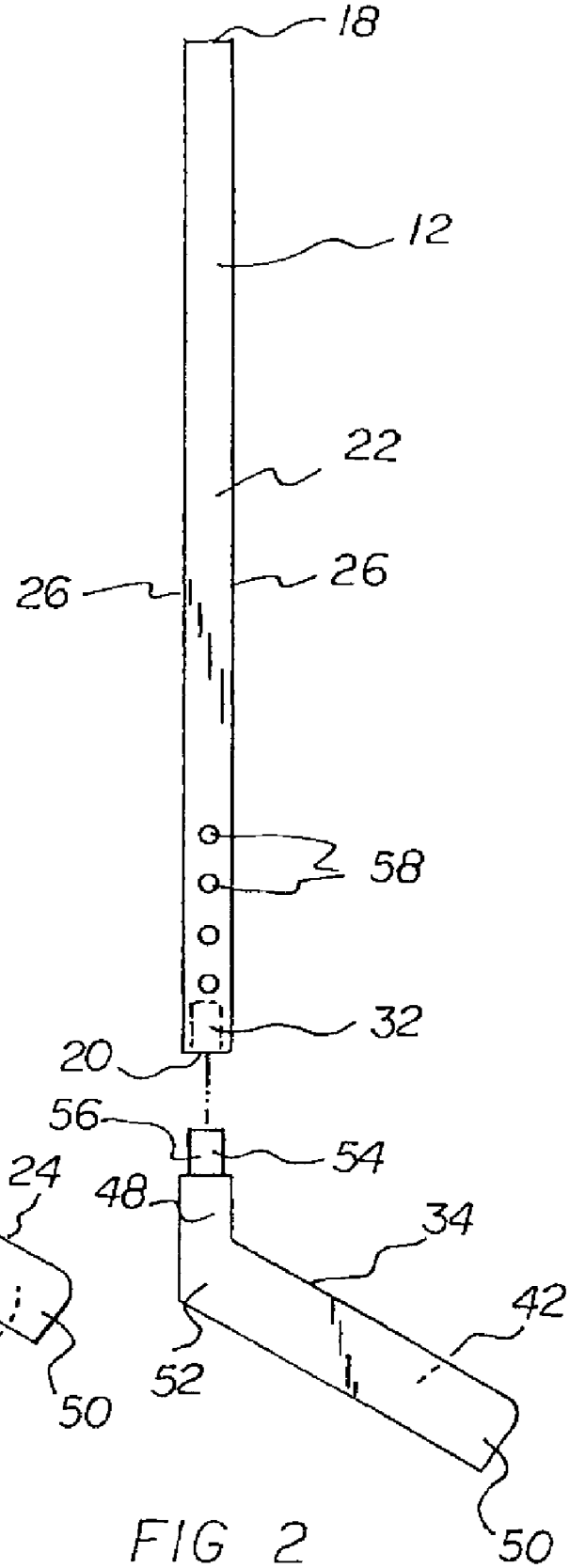
FIG. 2 is an exploded front elevational view of the hockey stick system shown in FIG. 1.
Figure 6:
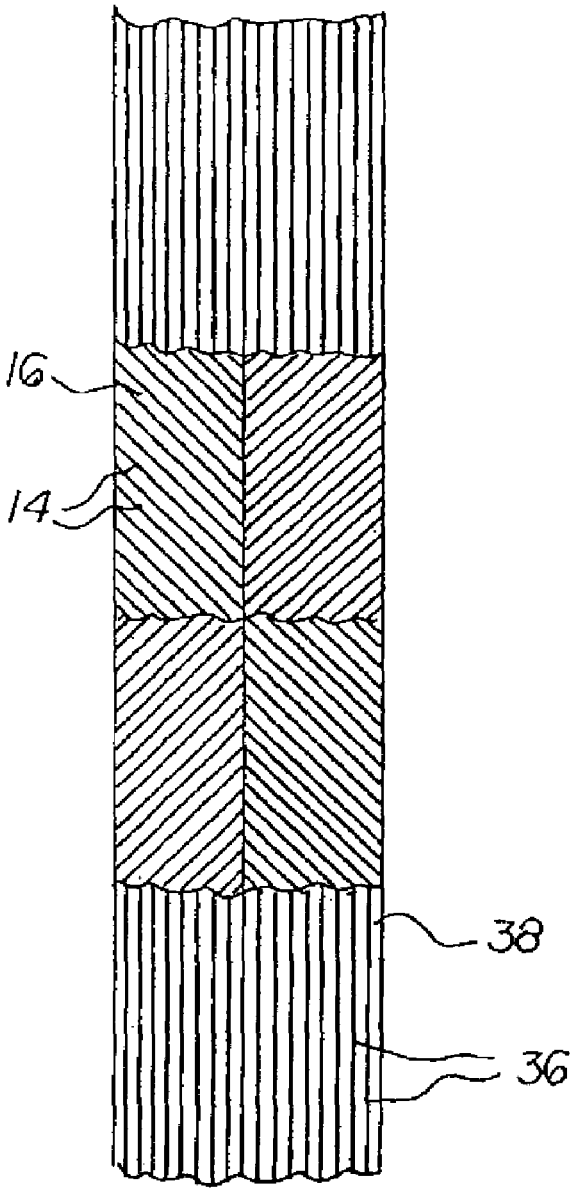
FIG. 6 is an isometric view of a potion of the shaft showing the various laminates used.

With reference now to the drawings, and in particular to FIGS. 1 through 5 thereof, the preferred embodiment of the new and improved composite hockey stick system embodying the principles and concepts of the present invention and generally designated by the reference numeral 10 will be described.

The present invention is a composite hockey stick system which is molded to form the desired shape. The two tubes make it possible to form an internal wall between the tubes which adds strength to the shaft. In addition, the tubes may be separated at various locations during the molding process to form ports or holes in the shaft.

With the present invention, automated production processes are not possible because of the geometric change in shaft design along the length of the shaft. Traditional composite hockey stick systems are constant in cross sectional shape and have a continuous wall. With the present invention, holes are molded at multiple locations along the length of the shaft therefore requiring a specific molding technique.

Each tube is preferably made from a long fiber reinforced prepreg type material. Traditional lightweight composite structures have traditionally been made by preparing an intermediate material known as a prepreg which will be used to mold the final structure. A prepreg is formed by impregnating the fibers, such as carbon, glass, and others, with resin. This is typically done using a prepreg machine, which applies the noncured resin over the fibers so they are all wetted out. The resin is at an "B Stage" meaning that only heat and pressure are required to complete the cross linking and harden and cure the resin. Traditionally, thermoset resins like epoxy are popular because they are available in liquid form at room temperature, which facilitates the impregnation process. A thermoset is created by a chemical reaction of two components, forming a material in a nonreversible process. Usually, the two components are available in liquid form, and after mixing together, will remain a liquid for a period of time before the crosslinking process begins. It is during this AB Stage@ that the prepreg process happens, where the resin coats the fibers. Common thermoset materials are epoxy, polyester, vinyl, phenolic, polyimide, and others.

The prepreg sheets are cut and stacked according to a specific sequence, paying attention to the fiber orientation of each ply. Generally is it desireable to have a symmetrical sequence, meaning that in the final laminate, the same fiber orientation is present above and below the centerline of the laminate, at the same distance. Each ply will have a specific fiber orientation depending on the performance required.

Each prepreg layer comprises an epoxy resin combined with unidirectional parallel fibers from the class of fibers including but not limited to carbon fibers, glass fibers, aramid fibers, and boron fibers.

The prepreg is cut into strips at various angles and laid up on a table. The strips are then stacked in an alternating fashion such that the fibers of each layer are different to the adjacent layers. For example, one layer may be +30 degrees, the next layer −30 degrees. If more bending stiffness is desired, a lower angle such as 20 degrees can be used. If more torsional stiffness is desired, a higher angle such as 45 degrees can be used. In addition, 0 degrees can be used for maximum bending stiffness, and 90 degrees can be used to resist impact forces and to maintain the geometric structural shape of the tube.

This layup, which comprises various strips of prepreg material, is then rolled up into a tube. A thin walled polymeric bladder is then inserted into the tube. This bladder will be used to internally inflate the tube when placed in the mold.

Another similar tube is prepared. The two tubes are then packed into a mold which forms the shape of the hockey stick. Typically the two tubes will be positioned side by side so that the common wall between the tubes is the short dimension of the rectangular shaped cross section of the shaft. The mold and tubes are typically longer than the final desired dimension of the hockey stick so a final cut to length operation can be done.

Air fittings are applied to the interior of the bladder on each end of each tube. The mold is then closed over the tubes and placed in a heated platen press. For epoxy resins, the temperature is typically around 350 degrees F. While the mold is being heated, the tubes are internally pressurized which compresses the prepreg material and cures the epoxy resin. Once cured, the mold is opened and the part is removed.

If apertures or spaces between the tubes are desired, then the mold must have provisions for such. Typically the mold will have pins positioned in the mold to form these openings. The pins can be positioned using side plates in the mold. The procedure would be to pack the first tube into the bottom part of the mold. Then, the side plates with the pins are positioned over the tube. The second tube is then placed over the pins. Finally, the top portion of the mold is positioned and the mold is closed. If desired, additional reinforcement can be wrapped around each pin prior to placing in the mold.

When the mold is heated up and air pressure is applied, the prepreg material becomes soft and conforms around each pin. Once cured, the mold is opened in the reverse sequence of packing. The top portion of the mold is removed, then the side plates are removed. Particular attention is needed when removing the side plates and pins to ensure that all pins are pushed out in a linear fashion. Once the pins are removed from the part, the part can be removed from the bottom portion of the mold.

The composite material used is preferably carbon fiber reinforced epoxy because the objective is to provide reinforcement at the lightest possible weight. Other fibers may be used such as fiberglass, aramid, boron and others. Other thermoset resins may be used such as polyester and vinyl ester. Thermoplastic resins may also be used such as nylon, ABS, PBT and others.

The resulting structure is unlike any hockey stick ever made. First of all, the internal wall adds strength because it helps prevent the tube from collapsing during bending. Hollow tubes are susceptible to buckling failure when being flexed to extreme amounts. This is because when being flexed, a portion of the tube is under compressive forces, and the thin wall of the tube will buckle. With the internal wall, this significantly improves flexural strength by preventing the wall of the tube from buckling.

The hockey stick system of the present invention becomes even more unique when the apertures are molded in the structure. It is not necessary to change the exterior dimensions of the shaft when molding apertures. Therefore, the shaft becomes much more aerodynamic because the frontal area is significantly reduced. This is a great benefit to a hockey stick system. The hockey stick is long in length and can be difficult to generate fast swing speeds. For example, compared to a golf shaft which is about the same length, the hockey stick system is about four times to about six times greater in frontal area, therefore having much less aerodynamic.

Having aerodynamic apertures in the hockey shaft can significantly reduce aerodynamic drag. The size and spacing of each aperture can vary according to desired performance parameters. The orientation, or axis of the apertures is in line with the swing direction of the shaft therefore maximizing the aerodynamic benefit.

The size and spacing of the apertures can effect shaft stiffness in a desireable way. These apertures can direct the flex-point of the shaft toward the lower portion of the shaft if desired. A hockey stick system with a lower flex point is said to provide more velocity to the shot.

An unexpected benefit of the apertures in the shaft is that they actually improve the durability and strength of the shaft. This is because they act as arches to distribute the stress and strain in a very efficient manner. This is because during a typical hockey shot, the blade of the hockey stick contacts the ice with significant force, which induces an "out of plane" bending on the shaft. The molded apertures in the shaft allow more flex in this direction which can improve the fatigue resistance of the shaft.

A particular design modification is needed in order to bond a hockey shaft of the present invention to a typical blade. A hockey blade offers a male portion with a specific geometry that fits inside the tubular hockey stick system. The inside geometry of the hockey stick system of the present invention will not fit because of the internal wall formed between the two tubes. Therefore, in order to accommodate this geometric end condition, it is desirable to bring the two tubes together as one tube. This can be done several ways.

The first option is to have two different prepreg tube lengths. One tube would be the full length of the shaft, and the other would start at a point some distance from one end and then continue to the full length of the other end. The joint area where the shorter tube connects to the longer tube will typically require extra reinforcement which is not a problem with fiber reinforced composites.

The second option is to manufacture the hockey shaft of the present invention using three tubes. Two tubes will be of equal construction and length. Both will be slightly shorter than the full length of the shaft. Then a third tube is positioned over both tubes on one end. The bladders of both internal tubes continue out the back of the third tube. When inflated, the bladders will compress each of the longer tubes as well as the over wrapped third tube creating a unified structure. Again, as with the first option, additional reinforcement may be required in this joint region.

A third option is to use a coupling, or a third part sleeve, to bond the hockey shaft of the present invention to the blade. In this case, the tip region of the shaft shall be molded of an exterior shape equal to that of the blade portion. Then a tubular sleeve of short length can be positioned over both the blade portion and shaft portion and bonded into place.

It is also possible to design the blade attachment means using two male protrusions, each of which would be positioned into each of the tube regions of the hockey shaft.

A hockey stick system of the present invention can be molded as a one piece structure with the blade portion attached, therefore producing an entire hockey stick. In this case, there is no joint between the shaft and the blade. The stick is made with longer prepreg tubes which are joined to the blade construction prior to molding. The entire stick with all components, shaft and blade, are molded together in one operation. It is also possible to have a precured blade, which is then placed in a mold for bonding to the prepreg shaft as it is cured. It is also possible to have a precured (or molded) shaft and blade, then place both into a mold with prepreg reinforcements wrapped around the joint or interface between the shaft and blade in order to make a one piece unit.

Another alternative is to use an extruded aluminum, or other metal, tube for the shaft that is partial length, then join this to the dual tube shaft that has the apertures. Specifically, the aluminum tube would start at the handle end, then join to the composite tube somewhere along the length of the shaft depending on how many apertures were desired. This provides a low cost alternative to the full length carbon fiber design.

The hockey stick system of the present invention is not limited to ice hockey stick systems. It can also be applied to field hockey stick systems. In fact, the aerodynamic benefits have a greater potential with field hockey because the frontal width of field hockey stick systems is much greater than ice hockey shafts.

With greater reference to FIGS. 1 through 6 of the drawings, the present invention is a composite hockey stick system 10. The system features geometric shapes in the shaft for improving the flexibility, strength and other playing characteristics of the system. The system comprises, in combination, a handle end and a striking end with a shaft there between. The stick handle end 12 is fabricated of multiple layers of fiber reinforced resin such as aligned carbon filaments 14 and 36 held together with an epoxy binder 16. The stick handle end has a long generally hollow rectangular configuration with a top end 18, a bottom end 20, a front face 22, a bottom face 24, and a pair side faces 26. The stick handle end has a central wall 28 running vertically and generally parallel with the side faces forming two adjacent tubes 30 with hollow interiors along the extent of the stick handle end. The stick has a recessed opening 32 in the bottom end thereof.

The fibers are linearly aligned in the primary embodiment. In an alternate embodiment there are chopped fibers. In another alternate embodiment there are braided fibers.

Next provided in the system is a stick striking end 34 fabricated of wood laminate wrapped with multiple layers of fiber reinforcement held together with an resin binder 38. The striking end may also be made of 100% composite materials such as fiberglass or carbon filaments in an epoxy resin. The stick striking end has a generally thin rectangular configuration with a first face 40, a second face 42, an upper edge 44, a lower edge 46, a near end 48, and a far end 50. The near end has a bend 52 at an angle between 45 degrees and 80 degree and being preferably 65 degrees measured between the side faces of the stick handle end and the upper edge and the lower edge. The near end of the stick handle end has a connecting bar 54 extending outwardly therefrom with the connecting bar being adapted to couple into the opening in the bottom end of the stick handle end. Also note the one piece integrated manufacturing alternative previously mentioned that doesn't need a connecting bar.

An adhesive 56 couples the stick handle end with the stick striking end between the connecting bar and the opening in the stick handle end.

The stick handle end and the stick striking end are configured together to form a shaft which is generally linear in shape.

Lastly provided are a plurality of oval apertures 58 formed in the stick tip end. The apertures extending between the front face and the bottom face. Each aperture is preferably oval in shape, with the long axis of the oval in line with the vertical axis of the shaft. Each aperture includes an interior wall defining an associated hole. The apertures and interior walls are located toward the bottom end of the shaft. The apertures separate the adjacent portions of the tubes of the shaft creating openings of increased surface area.

Lastly provided are a plurality of cylindrical or ovoid holes or apertures 58 formed in the stick handle end. The apertures extending between the front face and the bottom face. Each aperture includes a cylindrical wall defining an associated hole. The apertures and cylindrical walls are aligned linearly along a central vertical axis of the stick handle end and are adjacent to bottom end. The apertures impinge on the adjacent portions of the tubes of the stick handle end allowing for increased surface area.

Figure 7:
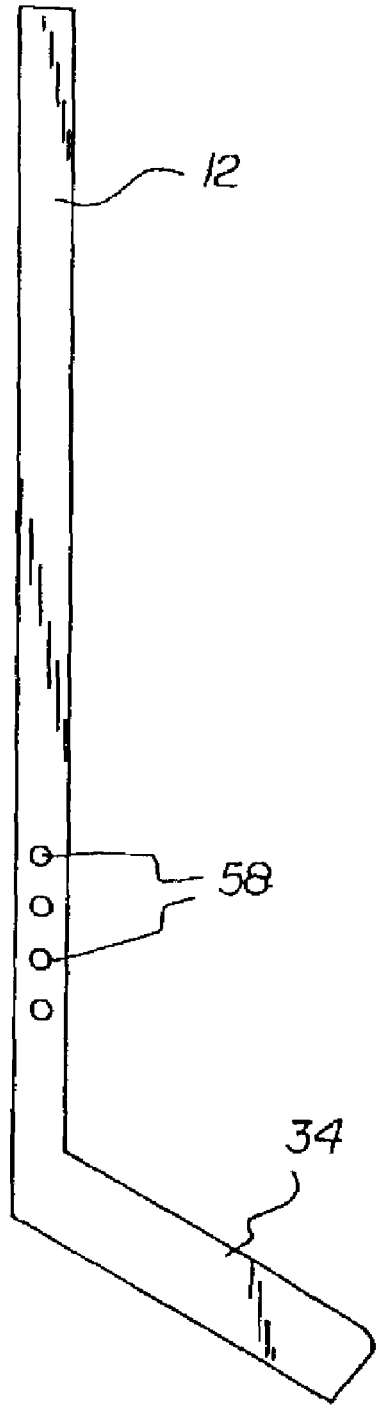
FIG. 7 is a front elevational view of a hockey stick system, shaft and blade, constructed in accordance with an alternate embodiment of the present invention.

An alternate embodiment of the invention is illustrated in FIG. 7. Such embodiment is a one piece hockey stick with its handle stick end 12 and striking stick end 34 fabricated with apertures 58 there through. In this alternative embodiment the hockey stick can be made as a one piece unit as previously described where the stick and blade portions are molded together reinforced with composite materials. Another option, which will produce a product of similar appearance, is to replace a portion of the stick handle end with a metal tube, preferably aluminum. It is understood that this embodiment could also be constructed using different materials fused together to provide the appearance of a one piece part.

The primary embodiment is configured as a stick for ice hockey. In an alternate embodiment, the stick is configured for field hockey. In a further alternate embodiment, the stick is configured for roller hockey.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A hockey stick comprising:

a shaft formed of two hollow tubes, each tube having a length, the tubes being coextensive and having facing surfaces along their length, wherein portions of said facing surfaces are fused together along fused portions to form an integral interior wall of the shaft, and wherein said tubes have non-facing surfaces which form external surfaces of the shaft, wherein the external surface of one tube adjoins the external surface of the other tube on opposite sides of said shaft to define a hollow interior of the shaft, and wherein said interior wall extends from adjoining external surfaces of said hollow tubes on one side of said shaft, through the hollow interior of the shaft, to adjoining exterior surfaces of said hollow tubes on an opposite side of said shaft;

wherein said facing surfaces are separated from one another at one or more locations between fused portions such that the walls of the facing surfaces at the separated locations define one or more apertures which extend through the shaft in a direction at least generally perpendicular to the longitudinal axis, the apertures being defined by separated, facing surfaces of the tubes, wherein said apertures are formed without forming holes through either tube; and wherein the facing surfaces of the two or more tubes comprise a composite material including a plurality of fiber layers, the composite material extending continuously along said fused portions and the one or more locations at which the facing surfaces are separated to form one or more apertures; and a striking end secured to one end of said shaft.

2. The hockey stick of claim 1, wherein said shaft and said striking end are bonded to one another.

3. The hockey stick of claim 1, wherein said shaft and said striking end are formed separately and joined mechanically.

4. The hockey stick of claim 1, wherein said facing surfaces of said tubes are separated from one another at a plurality of locations along the length of the shaft so as to form multiple apertures through said shaft.

5. The hockey stick of claim 1, wherein the striking end is selected from a group consisting of an ice hockey blade, a roller hockey blade, and a field hockey blade.

6. The hockey stick of claim 1, wherein said striking end lies generally in a plane, and wherein said interior wall and said one or more apertures are oriented at least generally perpendicular to said plane.

7. The hockey stick of claim 1, wherein each of said one or more apertures has an axis, and further wherein the axes of at least two apertures are parallel to one another.

8. The hockey stick of claim 1, wherein said striking end comprises a blade extending at an angle relative to said shaft, and wherein said interior wall and said one or more apertures are oriented at least generally perpendicular to said blade.

9. A composite hockey stick comprising:

a shaft, having a longitudinal axis and being formed of two hollow tubes, each tube having a length, the tubes being coextensive and having facing surfaces along their length, wherein portions of said facing surfaces are fused together along fused portions to form an integral interior wall of the shaft, and wherein said tubes have non-facing surfaces which form external surfaces of the shaft, wherein the external surface of one tube adjoins the external surface of the other tube on opposite sides of said shaft to define a hollow interior of the shaft, and wherein said interior wall extends from adjoining external surfaces of said hollow tubes on one side of said shaft, through the hollow interior of the shaft, to adjoining exterior surfaces of said hollow tubes on an opposite side of said shaft;

wherein said facing surfaces are separated from one another at one or more locations between fused portions such that the walls of the facing surfaces at the separated locations define one or more apertures which extend through the shaft in a direction at least generally perpendicular to the longitudinal axis, the apertures being defined by separated, facing surfaces of the tubes, wherein said apertures are formed without forming holes through either tube;

wherein each tube is fabricated of multiple layers of reinforcing filaments held together with a resin binder, and wherein said shaft, in cross-section, has rectangular shape defined by the external surfaces of said tubes;

a striking end fabricated of multiple layers of reinforcing filaments held together with a resin binder, said striking end having a generally thin configuration with a first face, a second face, an upper edge, a lower edge, a near end, and a far end with the near end having a bend at an angle between 45 degrees and 80 degrees measured between the side faces of said shaft and the upper edge and the lower edge, said near end of said shaft having a connecting bar adapted to coupled into an opening in the bottom end of said shaft; and an adhesive coupling the stick handle end with the stick striking end.

* * * * *